US007273007B2

(12) United States Patent
DeMoore et al.

(10) Patent No.: US 7,273,007 B2
(45) Date of Patent: Sep. 25, 2007

(54) PORTABLE PRINTER COATER

(75) Inventors: Howard W. DeMoore, Dallas, TX (US); Ron Rendleman, Dallas, TX (US)

(73) Assignee: Printing Research, Inc., Dallas, TX (US)

( * ) Notice: Subject to any disclaimer, the term of this patent is extended or adjusted under 35 U.S.C. 154(b) by 123 days.

(21) Appl. No.: 10/962,021

(22) Filed: Oct. 8, 2004

(65) Prior Publication Data

US 2006/0065144 A1 Mar. 30, 2006

Related U.S. Application Data

(60) Provisional application No. 60/613,285, filed on Sep. 27, 2004.

(51) Int. Cl.
*B41F 5/00* (2006.01)

(52) U.S. Cl. ..... 101/216; 101/479

(58) Field of Classification Search ..... 101/424.2, 101/483, 216, 364, 479, 350.1, 232; 118/46, 118/258, 256
See application file for complete search history.

(56) References Cited

U.S. PATENT DOCUMENTS 3,783,782 A * 1/1974 Hardt ..... 101/216
4,528,907 A 7/1985 Davison
4,685,414 A 8/1987 DiRico ..... 118/46
4,796,556 A 1/1989 Bird ..... 118/46
4,841,903 A 6/1989 Bird ..... 118/46
4,889,051 A 12/1989 Sarda ..... 101/77
4,901,641 A * 2/1990 Steiner et al. ..... 101/152
4,934,305 A 6/1990 Koehler et al. ..... 118/46
5,060,569 A * 10/1991 Gladow ..... 101/216
5,176,077 A 1/1993 DeMoore et al. ..... 101/142
5,178,678 A 1/1993 Koehler et al. ..... 118/46
5,207,159 A 5/1993 DeMoore et al.
5,421,146 A * 6/1995 Visser ..... 56/328.1
5,651,316 A 7/1997 DeMoore et al. ..... 101/450.1
5,813,582 A * 9/1998 Wright ..... 224/407

(Continued)

FOREIGN PATENT DOCUMENTS

WO WO 02/087881 A1 11/2002

OTHER PUBLICATIONS

Internationl Search Report, PCT/US2005/033951, May 19, 2006, 6 pgs.

(Continued)

*Primary Examiner*—Anthony H. Nguyen
(74) *Attorney, Agent, or Firm*—Conley Rose, P.C.

(57) ABSTRACT

A portable printer coater for use with a printing press includes: a counter for indicating wear on seal components, a system for installing and removing the coater without lifting, and a tensioner for improving lifetime of seals in the chambered doctor. The counter records operating time or revolutions and provides an output indicating consumed lifespan or remaining lifespan. A split catwalk is provided on a press and rollers are provided on the printer coater to facilitate moving the printer coater into engagement with the press. A cart is used to move the printer coater adjacent the press and rails are used to move the printer coater from the cart onto the catwalk. One adjustable tensioner is positioned to apply force to the center of the chambered doctor and reduced wear on seal components.

12 Claims, 13 Drawing Sheets

U.S. PATENT DOCUMENTS 5,937,749 A * 8/1999 Ford ..... 101/115
6,038,972 A * 3/2000 Delwiche et al. ..... 101/216
6,152,068 A * 11/2000 Colson et al. ..... 118/46
6,244,174 B1 6/2001 Sirowitzki et al.
6,612,234 B2 9/2003 Hess ..... 101/216
6,748,859 B2 * 6/2004 Goldburt et al. ..... 101/350.1

OTHER PUBLICATIONS

Written Opinion of the International Searching Authority, PCT/US2005/033951, May 19, 2006, 8 pgs.

* cited by examiner

PORTABLE PRINTER COATER

CROSS-REFERENCE TO RELATED APPLICATIONS

This application claims priority to U.S. Provisional Patent Application Ser. No. 60/613,285, filed Sep. 27, 2004, by the same inventors.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

This invention relates to the printing industry, and in particular, to enhancements of a lightweight portable and compact flexographic printer coater for movement to any printing unit on a multi-unit rotary offset lithographic printing press for inking or coating purposes.

BACKGROUND OF THE INVENTION

Offset lithography is a process well known in the art which utilizes the planographic method. Image and non-printing areas are essentially on the same plane of a thin metal plate and the distinction between them is maintained chemically. Ink is offset from a plate on the plate cylinder to a rubber blanket on a blanket cylinder and then from the blanket to a substrate supported on an impression cylinder on which printing occurs.

Conventional sheet-fed, rotary offset printing presses typically include one or more printing units through which individual sheets are fed and printed. After the last printing unit, freshly printed sheets are transferred by a delivery conveyor to the delivery end of the press where they are collected and stacked uniformly. In a typical sheet-fed, rotary offset printing press, the delivery conveyor includes endless chains carrying gripper bars with gripper fingers which grip and pull freshly printed sheets from the last impression cylinder and convey them to the sheet delivery stacker.

Printed lithographic ink on the surface of the substrate sheet dries relatively slowly through oxidation and is easily smeared by subsequent transfer cylinders between the individual printing units of the press. Any relative movement of the freshly printed surface relative to a support surface can result in smearing. Modified and specialized equipment and techniques have been developed to combat this problem.

A related problem that is faced in the prior art is the problem of "offsetting" and "set off" of freshly printed ink at the delivery end of the press after the printed sheets are collected and stacked. A similar problem occurs in roll form material produced on a web-fed press. In some printing jobs, offsetting is prevented by applying a protective and/or decorative coating material over all or a portion of the freshly printed sheets. Some coatings are formed of an ultra-violet (UV)-curable or water-dispersed resin applied as a liquid solution over the freshly printed sheets to protect the ink from offsetting or set-off and improve the appearance of the freshly printed sheets. Such coatings are particularly desirable when decorative or protective finishes are applied in the printing of posters, record jackets, brochures, magazines, folding cartons and the like. In cases where coating is to be applied, the coating operation may be carried out after the last printing unit, most desirably by an in-line coating application. It is highly undesirable to process the sheet through the press a second time in order to apply coatings, although this is sometimes done for special effects that are not otherwise obtainable.

The ability to overall coat, spot coat or print with aqueous, flexographic and UV curable inks and/or coatings in combination with lithographic, flexographic and waterless printing processes on a rotary offset printing press is highly desirable. Flexographic printing or coating with aqueous, flexographic and UV curable inks from a blanket or a relief plate can permit much heavier wet and dried ink film layers on the substrate. This is largely due to the nature of lithographic inks. Lithographic inks are generally oil based inks that are formulated to print from planographic surfaces based on the principle that oil and water do not mix. Lithographic inks are generally very strong in color value to compensate for the lesser amount that is printed. They are among the strongest of all inks. The average amount of ink transferred to the paper is further diluted by the double split of the ink film between the plate cylinder and the blanket cylinder and between the blanket cylinder and the substrate to be printed in the nip between the blanket cylinder and the impression cylinder. In many situations, only a quarter of the film thickness on the plate is transferred to the substrate. This can make it difficult to obtain sufficient opacity with white or metallic (gold, silver or other metallic) ink or in printing specialized vehicles such as "scratch-and-sniff" materials from a slurry containing encapsulated essence. This often means that sheets or substrate must be removed and transferred to a second type of machine using the flexographic process to apply greater amounts of ink thickness or the sheets must make successive or two or more passes on a lithographic press to achieve desired print quality.

The prior art has attempted to solve these problems to obtain higher applied film weights on lithographic printing presses in a variety of ways. Much of the prior art has disadvantages. Retrofitting existing presses is often difficult because of space considerations, especially between printing units. A dedicated coating unit is often not possible because of limited space and involves press downtime and substantial capital costs. Retrofitted devices that utilize the print cylinder or blanket cylinder of the press can limit the ability of that station to lithographically print in the normal manner.

Coaters which utilize the plate cylinder or the blanket cylinder of the printing unit still suffer from the disadvantage that the coating is split which reduces the wet film thickness that can be applied to the substrate itself. A few add on coating units that print directly on the substrate on the impression cylinder or a transfer cylinder are limited to the last printing station on the press where there is more room for installation. Such equipment can be moved away or the operator can do the make ready work on the opposite side of the last printing station in the conventional work space for the operator. If such equipment is mounted in the interstation space on a lithographic press, the equipment interferes with operator access to the next station.

Much of the prior art consumes large areas of space on the press, both between printing units and in some instances in the overhead area because of the complexity and size of equipment, limited locations are available for which it can be used. Additionally, the prior art devices are heavy; thus, when installing these devices, cranes or similar equipment are often required to properly mount the devices in position. A further disadvantage is that these devices are expensive to manufacture and maintain. Finally, the prior art devices are not designed as portable devices for placement on different printing presses or on different printing units. Most printer coater devices are attached to a single printing unit and require extensive connections that must be disconnected requiring extensive labor and costs. Also, as stated previously, with some embodiments, each time a printer coater is moved, a crane or other transport device is required to remove and carry the printer coater to a different printing unit.

It is desirable not to have to cut into press frame to gain access to the main gears and not to have to manually engage and disengage indexed gear teeth of gears on the coater with gears on the press. The ability to flexographically coat, spot coat or print on the substrate at an intermediate printing station with an apparatus that is inexpensive and compact so that it can fit into small areas is highly desirable. It is also desirable to have a lightweight and portable device so that it can be carried by humans for use on any printing unit of a lithographic printing press or to a completely different printing press of the same size and installed or removed without the use of heavy equipment. In various embodiments, the device of the present disclosure may be able to provide various of these desirable results or even combinations of these desirable results.

SUMMARY OF THE INVENTION

In one embodiment, a portable printer coater for use with a printing press includes a counter for indicating wear on seal components. The counter records operating time or revolutions of an applicator roller and provides an output indicating consumed lifespan or remaining lifespan of a seal component such as a doctor blade.

In one embodiment, a portable printer coater for use with a printing press includes a system for installing and removing the coater in a press without lifting. A split catwalk is provided on a press and rollers are provided on the printer coater to facilitate moving the printer coater on the catwalk into engagement with the press. A cart may be used to move the printer coater adjacent the press and rails may be used to move the printer coater from the cart onto the catwalk.

In one embodiment, a portable printer coater for use with a printing press includes a tensioner for improving lifetime of seals in the chambered doctor. An adjustable tensioner is positioned to apply force to the center of the chambered doctor and reduced wear on seal components. In an embodiment in which the chambered doctor includes a fluid manifold near the center of the chambered doctor, the tensioner may apply force to the manifold.

These and other features and advantages will be more clearly understood from the following detailed description taken in conjunction with the accompanying drawings and claims.

BRIEF DESCRIPTION OF THE DRAWINGS

For a more complete understanding of the present disclosure and the advantages thereof, reference is now made to the following brief description, taken in connection with the accompanying drawings and detailed description, wherein like reference numerals represent like parts.

DETAILED DESCRIPTION OF THE PREFERRED EMBODIMENTS

It should be understood at the outset that although an exemplary implementation of one embodiment of the present disclosure is illustrated below, the present system may be implemented using any number of techniques, whether currently known or in existence. The present disclosure should in no way be limited to the exemplary implementations, drawings, and techniques illustrated below, including the exemplary design and implementation illustrated and described herein.

The present disclosure teaches several enhancements of a portable printer coater, including: a counter and/or timer to track the lifetime of consumable seals whereby to replace seals before failure during a printing run, a system for transporting and installing the portable printer coater by a single operator, a tensioner device which may extend the life of the consumable seals, and a teflon lining to critical components to facilitate ease of cleanup of the portable printer coater. While in the preferred embodiment, the enhancements pertain to a lightweight portable compact printer coater as described in detail hereinafter, it will be readily appreciated by one of ordinary skill in the art that the enhancements disclosed herein can be used with other embodiments of a portable printer coater.

Figure 1:
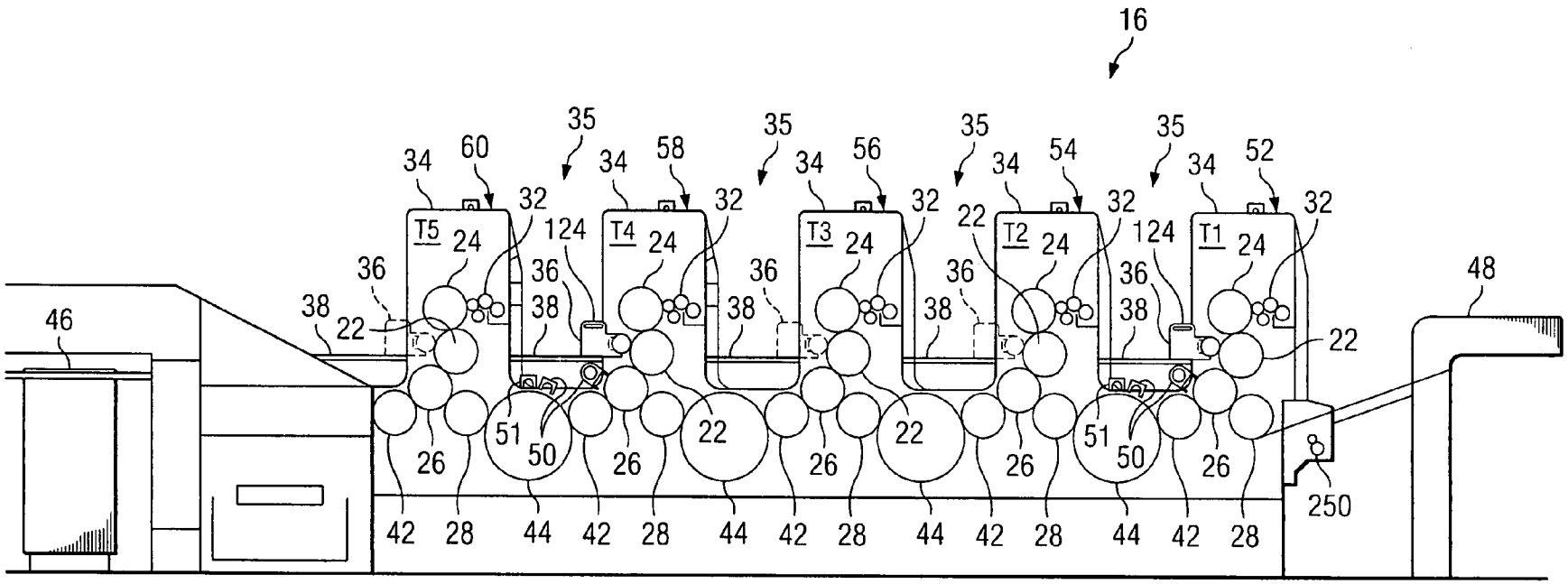
FIG. 1 is a simplified side view of a five station rotary offset lithographic printing press showing the portable inking/coating apparatus of the invention placed on the first and fourth printing unit at the blanket cylinders and in phantom illustrating other positions where the inking/coating apparatus may also be placed.

In the preferred embodiment, the enhancements of the present disclosure pertain to a lightweight portable compact printer coater 36 for use on a sheet-fed or web-fed rotary offset lithographic printing press, herein generally designated 16. Referring to FIG. 1, rotary offset printing press 16 includes a press frame 34 coupled at one end to a sheet feeder 48 from which sheets to be printed are fed into the printing press. On the opposite end, a stacker 46 collects and stacks the freshly printed sheets. Between sheet feeder 48 and stacker 46 are five substantially identical sheet printing units 52, 54, 56, 58 and 60 which can lithographically print five different colors onto the sheets as they are transferred through the press 16. As illustrated, the printing units 52, 54, 56, 58 and 60 are identical and of conventional design. Each printing unit includes an in feed transfer cylinder 28, a plate cylinder 24, a blanket cylinder 22 and an impression cylinder 26. These cylinders are supported for rotation by printing press frame 34 which define printing unit towers T1, T2, T3, T4 and T5. Each of the first four printing units have a transfer cylinder 42 disposed to transfer the freshly printed sheets from the adjacent impression cylinder 26 to the next printer unit via an intermediate transfer cylinder 44.

As shown in FIG. 1, the lightweight portable compact printer coater 36 can be installed on any printing unit of press 16. Printer coater 36 is positioned above raised catwalk 38 on the first and fourth printing units adjacent blanket cylinder 22. Printer coater 36 is lightweight and compact so that humans can remove and carry the apparatus from a given printing unit for placement on different printing units or printing presses in little time and with minimal difficulty. Phantom lines on FIG. 1 illustrate other positions where printer coater 36 may be placed on press 16 in impression with a rotating printing surface.

Figure 2:
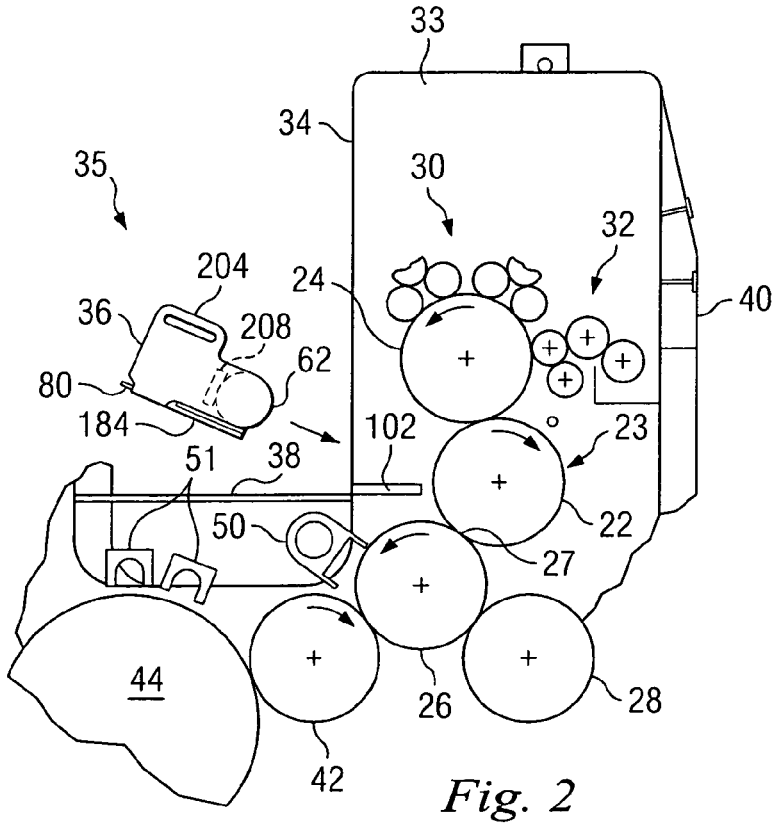
FIG. 2 is a simplified side view of a rotary offset printing press printing unit as seen in FIG. 1 showing the portable inking/coating apparatus of the invention being inserted into the printing unit for placement adjacent the blanket cylinder.
Figure 9:
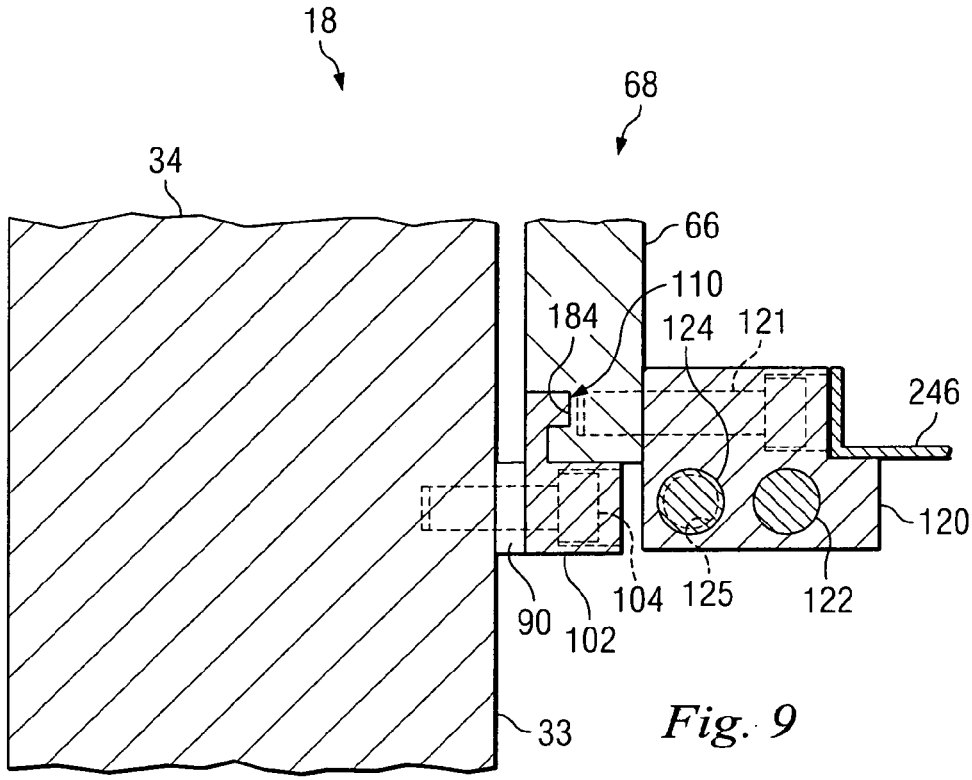
FIG. 9 shows a partial section view of the printer coater frame and press frame connection taken on the line 9-9 in FIG. 6.

Referring to FIG. 2, a close up view of a printing unit on press 16 shows plate cylinder 24 in operation with inking roller train 30 and dampening system 32. Blanket cylinder 22 is located beneath plate cylinder 24, where the printer coater apparatus is preferably placed. In this figure, printer coater 36 is being aligned and inserted into position adjacent blanket cylinder 22. A pair of fixed supports 102 are mounted parallel to each other and attached to the interior surfaces 33 of frame 34. One support is placed on the drive side and the other support is placed on the operator side. FIG. 2 illustrates one fixed support 102 mounted on the drive side of press 16. Fixed supports 102 provide support for printer coater 36 when the apparatus is placed inside the printing unit. When inserting printer coater 36, side member slots 184 seen in FIG. 9 are aligned with fixed supports 102 so that the printer coater may be moved into position.

Figure 3:
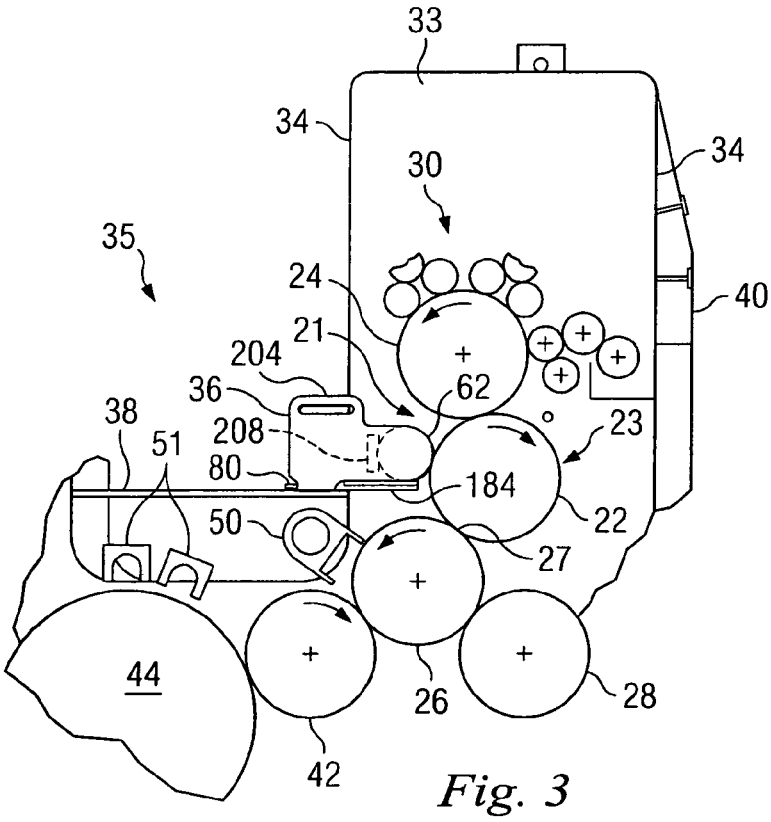
FIG. 3 is a simplified side view of the rotary offset printing unit of FIG. 2 after it has been moved into inking/coating position adjacent the blanket cylinder.

Referring to FIG. 3, printer coater 36 is positioned on the same printing unit as shown in FIG. 2. Printer coater 36 is aligned with blanket cylinder 22 and is supported by fixed supports 102. Printer coater 36 rests slightly above raised catwalk 38 consuming minimal space to allow operator access at interstation area 35. While in the on-impression position, printer coater 36 applies a flexographic inking or coating substance to blanket cylinder 22 which rotates synchronously with impression cylinder 26. The printing substrate, which is paper or other material in sheet or web form, is fed over impression cylinder 26 and is in printing contact with blanket cylinder 22. When the substrate passes contact point 27, it is dried by dryer 50. As the substrate continues to the next printing unit and over intermediate transfer cylinder 44, it is further dried by a drying means 51. Drying means 51 can include high velocity air with or without extraction, ultra-violet radiation, infra-red radiation or other suitable drying or curing means.

Figure 4:
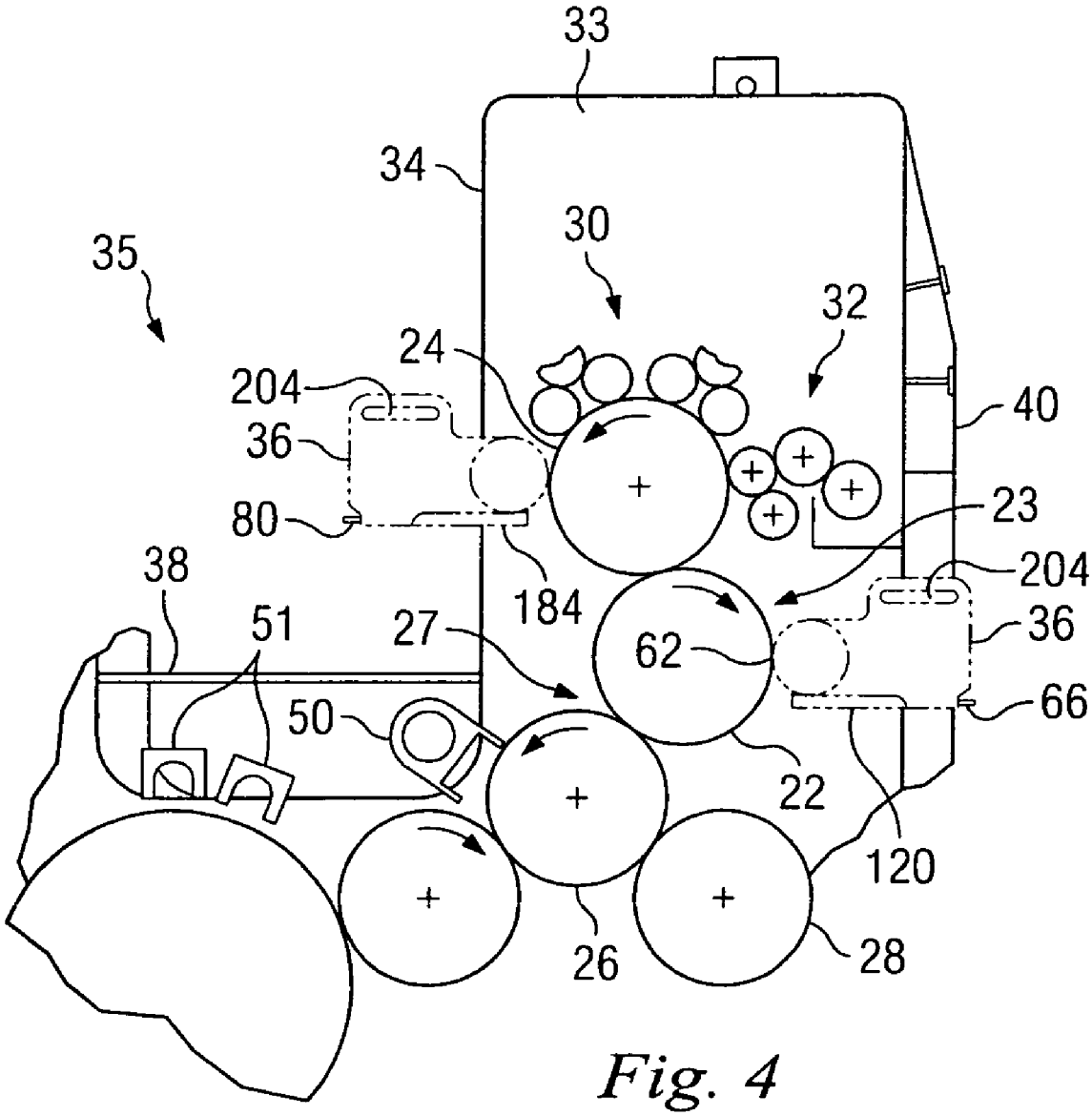
FIG. 4 is a simplified side view of a rotary offset printing unit of FIGS. 1-3 showing the inking/coating apparatus may be placed in alternative positions adjacent the plate cylinder and adjacent the blanket cylinder on the feed side.

FIG. 4 illustrates alternate placement positions on a printing unit of press 16 for printer coater 36. As seen, the printer coater can be placed adjacent plate cylinder 24 or adjacent blanket cylinder 22 on feed side 35. In such case fixed supports 102 are mounted at appropriate places on the inner sides of the press frame 34.

Figure 5:
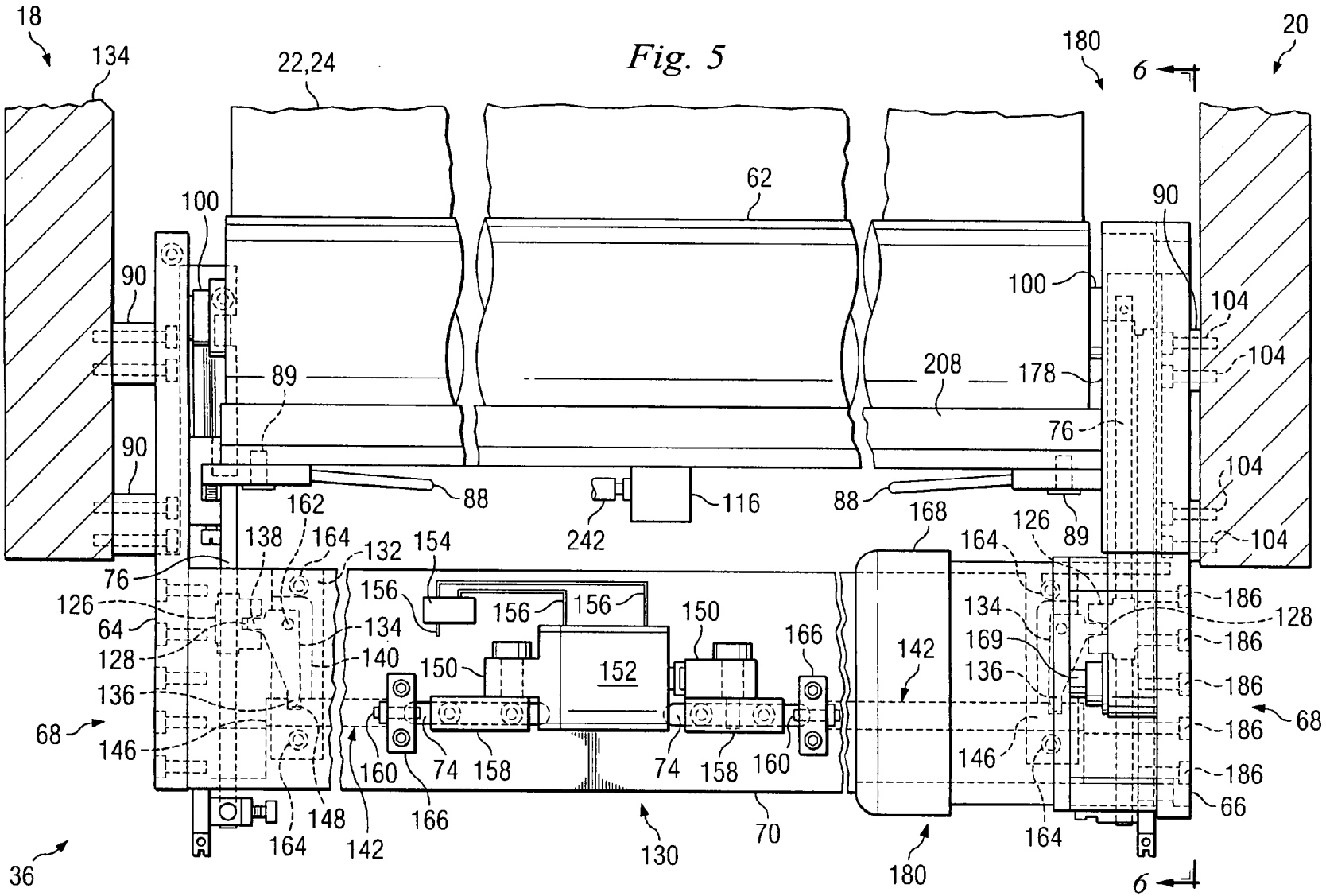
FIG. 5 show a top plan view of the printer coater apparatus of FIGS. 1-4 mounted to the printing press frame.

FIG. 5 exhibits a top view of printer coater 36 mounted to frame 34. Printer coater apparatus 36 comprises a drive side side member 64, an operator side side member 66 and a base or cross member 70 that rigidly connects the side members. All of these components form printer coater frame 68. Frame 68 supports applicator roller 62, drive assembly 180 (as best seen in FIG. 6), liquid chamber 208, and positioner 130 best seen in FIGS. 8 and 11.

In FIG. 5, applicator roller 62 is mounted on stub shafts 100 which are supported at opposite ends by two bearings (not shown), one bearing mounted on each side member 64 and 66. The bearings permit free rotation of applicator roller 62, which is rotated by electric motor 168. Applicator roller 62 is preferably an anilox metering roller which transfers measured amounts of printing ink or coating material to a rotating printing surface. Anilox roller 62 is preferably a lightweight anilox roller made of a non-metallic composite material having a wear resistant ceramic anilox surface for applying printing ink or coating material. In one embodiment, anilox roller 62 can be fabricated by and purchased from Pamarco Global Graphics.

Figure 6:
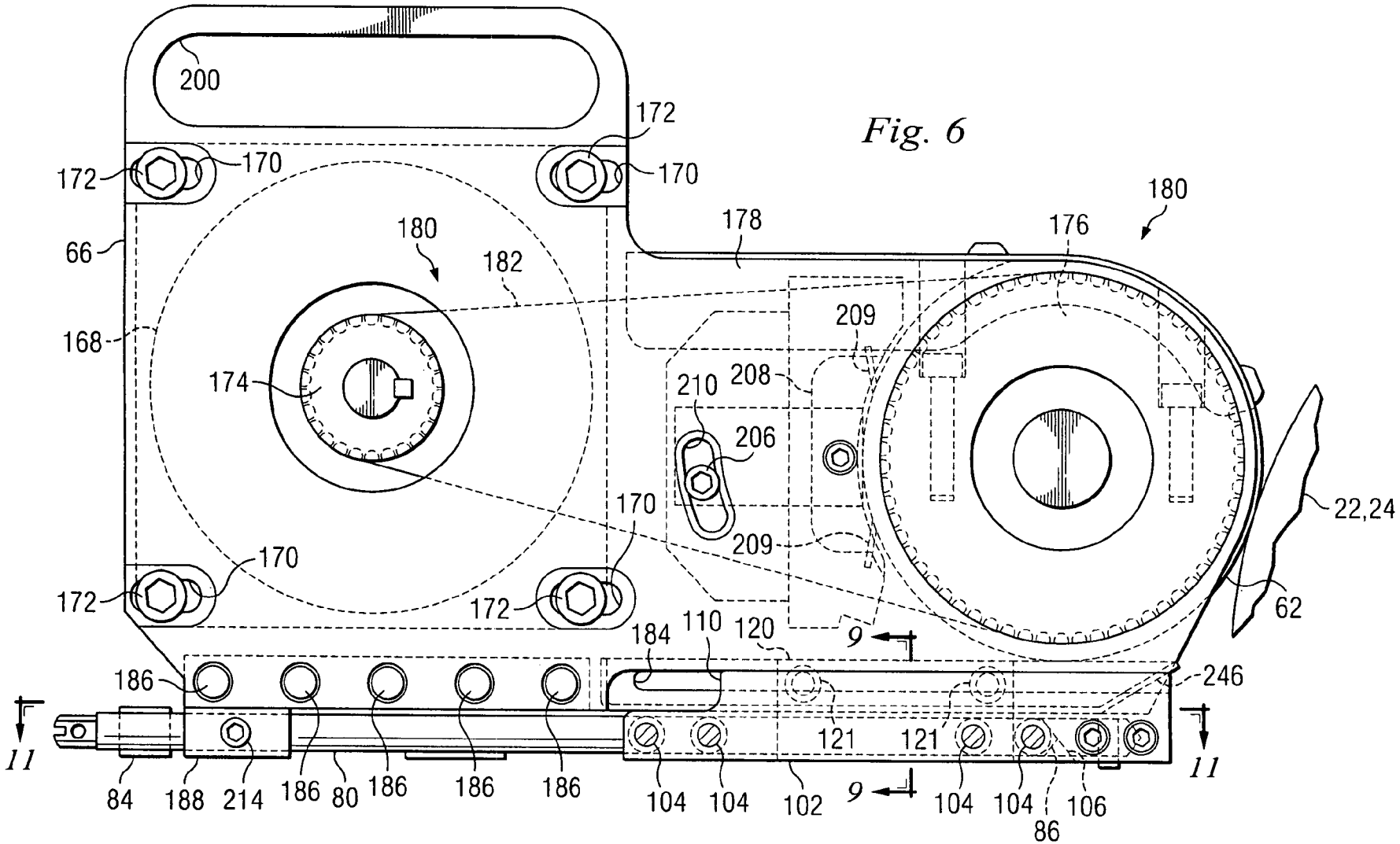
FIG. 6 is a side end view of the printer coater apparatus of the invention viewed from the operator side of the press.

Turning now to FIG. 6, liquid chamber 208 is mounted on frame 68 adjacent roller 62 to supply fluid inking or coating materials to roller 62. The inking or coating fluid is preferably a flexographic or IR curable or ultraviolet (UV) curable inking or coating material. Liquid from chamber 208 flows onto the surface of roller 62 to replenish the wet film as the anilox roller rotates through the chamber. The transfer surface of the anilox roller is "doctored" (wiped or scraped) by reverse doctor blades 209, as seen in FIG. 6, to remove excess ink or coating material. Furthermore, doctor blades 209 and suitable end seals (not shown) also provide a seal for the liquid supply chamber. Air bubbles entrapped on the surface of anilox roller 62 are displaced by wiping the surface of the applicator roller with bristles of a brush (not shown) located inside liquid supply chamber 208, as set forth in U.S. Pat. Nos. 5,425,809 and 5,989,639, assigned to Printing Research, Inc., which are incorporated herein by reference. This promotes the flow of inking or coating materials onto applicator roller surface 62.

Referring back to FIG. 5, hose 242 connects to fluid entry port 116 on chamber 208 to direct fresh inking or coating substance inside the chamber. Fluid return hose 244 shown in FIG. 12 directs the excess liquid or inking substance from chamber 208 so that fresh liquid can be re-circulated into the chamber 208. These hoses are easily connected to and disconnected from printer coater 36 by quick release connections (not shown). Located on each end of chamber 208 are a pair of quick release handles 88, which pivot about pivot pin 89 to permit quick removal of the chamber from the printer coater frame.

Figure 8:
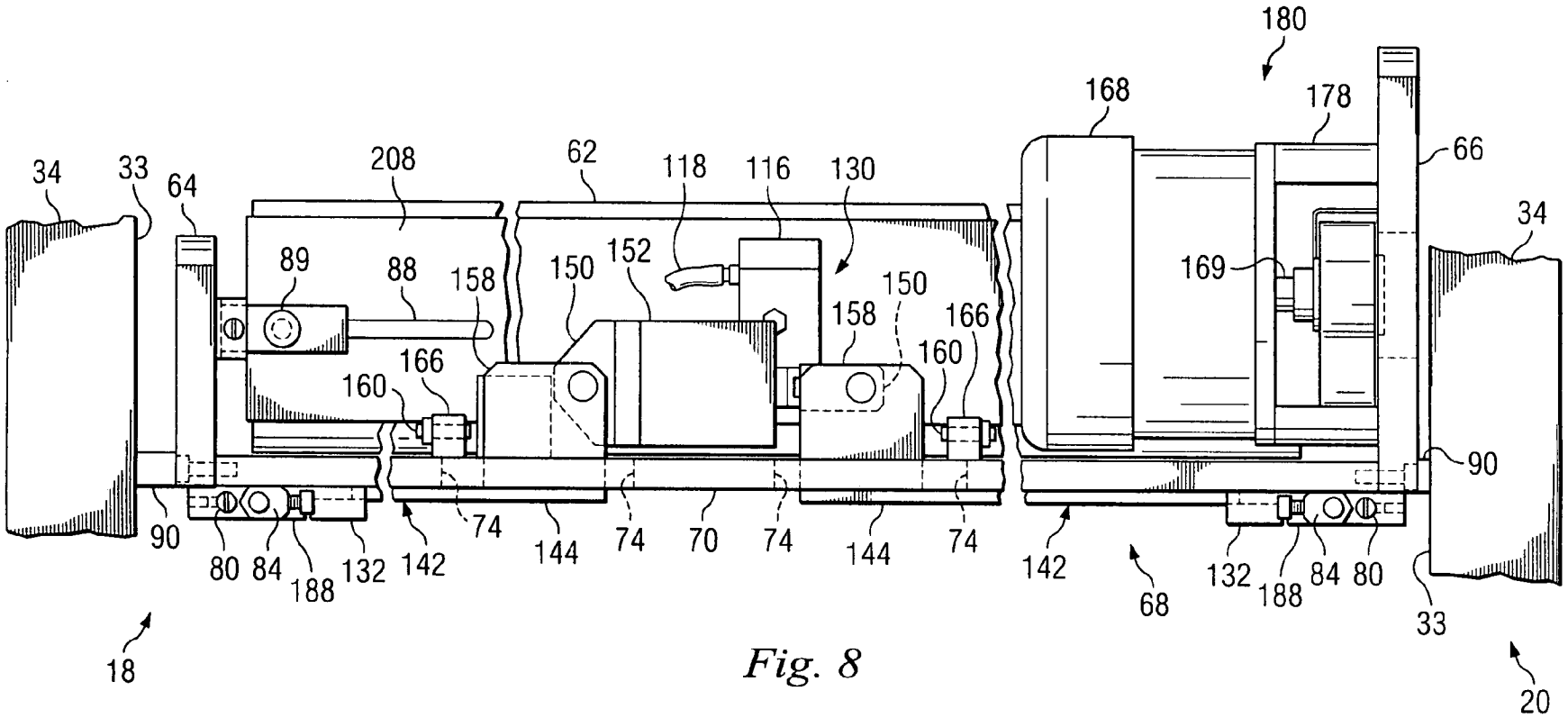
FIG. 8 is an elevational view of the printer coater apparatus from the back side showing the positioner apparatus and a drive motor connected to the printer coater frame.
Figure 11:
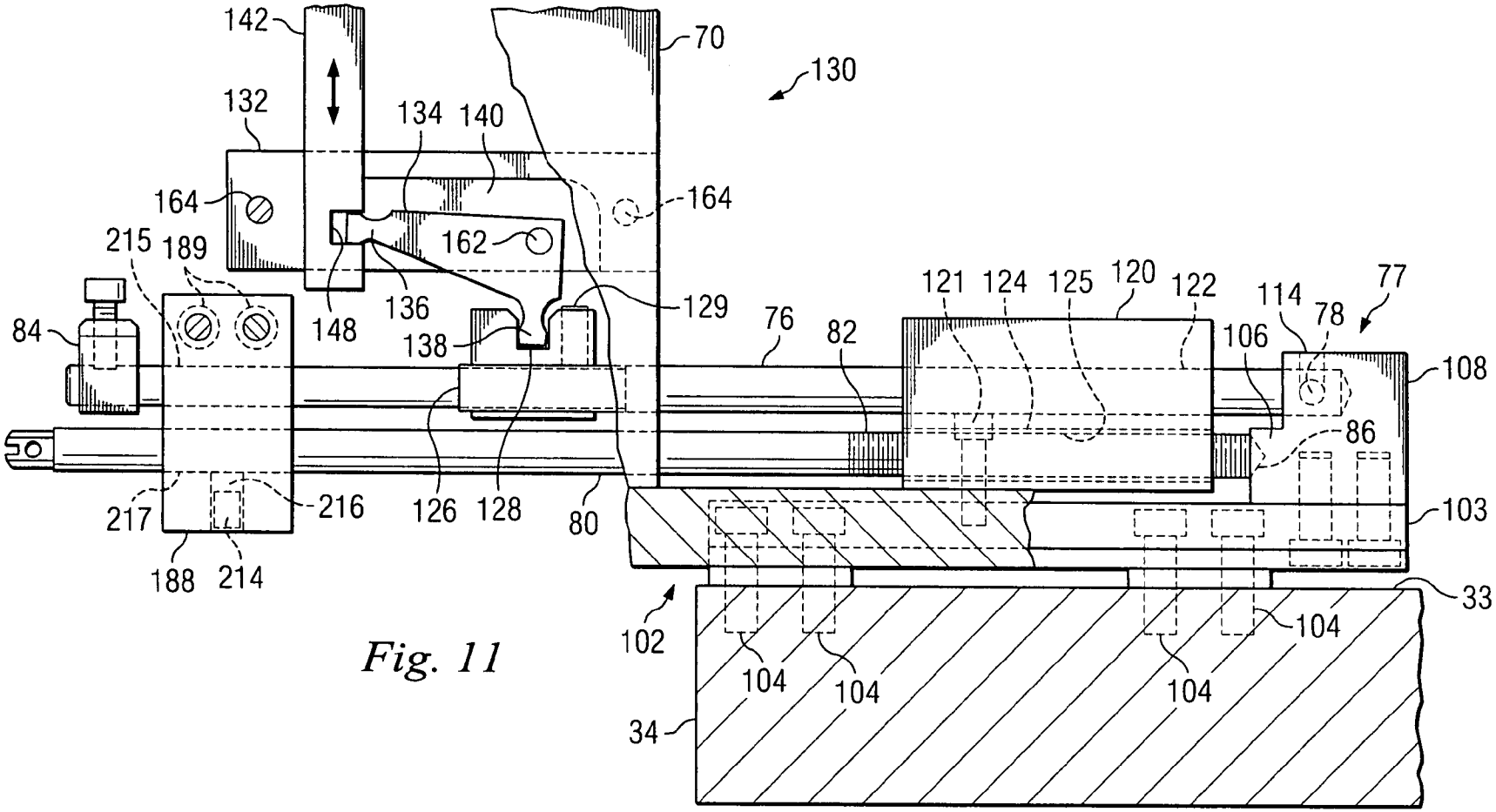
FIG. 11 shows a partial top plan view of one side of the printer coater apparatus after it is connected and locked to the press frame.

As seen in FIGS. 5 and 8, positioner 130 comprises a floating two way or double acting air cylinder 152 mounted above cross member 70. Air is supplied to cylinder 152 by air hoses 156 and is regulated by solenoid 154, which directs air into cylinder 152 to reciprocate the cylinder in the desired direction. Cylinder 152 has two brackets 150 connected to the cylinder and cylinder piston rod respectively which move in the transverse direction (toward side members 64 and 66) upon actuation of the cylinder. Cylinder 152 is not attached to printer coater frame 68 and floats to permit symmetrical movement of the brackets on both sides of the cylinder. Attached to brackets 150 are connecting members 158. These members are vertically oriented and extend beneath cross member 70 through slot 74. Two horizontally placed rigid members 142 are mounted below cross member 70 and attached to members 158. Examining rigid member 142 on drive side 18, member 142 has a first end 144 attached to connecting member 158 and a slot 148 on second end 146 (FIG. 5) to pivotally connect first arm 136 of bell crank 134. Bell crank 134 is pivotally mounted by means of pivot pin 162 to a housing 132. Housing 132 is rigidly fastened to cross member 70 by attachment bolts 164. Second arm 138 of bell crank 134 pivotally attaches to slot 128 on sleeve 126 which is securely mounted to lock-on 76 by set screw 129 (FIG. 11). Attachment and configuration for rigid member 142 on operator side 20 is the same as it is for the drive side attachment and configuration.

With reference to FIGS. 5 and 11, when air cylinder 152 actuates outwardly, rigid members 142 reciprocate in the transverse direction toward side members 64 and 66 causing bell cranks 134 to pivot. As a result of the pivoting motion, a force is exerted toward the blanket cylinder on sleeve slots 128. Because lock-on members 76 and sleeves 126 remain stationary with respect to the printer coater, they function as an anchor for relative movement of the printer coater and a track for the apparatus to slide thereon. Thus, the force from bell cranks 134 cause housings 132 and cross member 70 to move printer coater 36 in the longitudinal direction away from the blanket cylinder. The movable components will stop at a predetermined distance established by stop-blocks 166. Blocks 166 are affixed to the surface of cross member 70 and stop the motion of connecting members 158 as they are pushed toward side members 64 and 66. This establishes the outermost distance the printer coater will travel. Blocks 166 further comprise a fine adjustment screw 160 to adjust the distance that cross members may travel in the transverse direction.

When connecting members 158 are in contact with blocks 166, the printer coater is in the off-impression position. The printer coater remains at this position until cylinder 152 is actuated and retracts connecting members 158 inward away from members 64 and 66. This motion rotates cranks 134 so that bell crank second arm 138 exerts a force on sleeve slot 128 in a direction opposite the rotating printing surface. The force on sleeve slot 128 causes printer coater 36 to move in the longitudinal direction toward the rotating printing surface.

Figure 7:
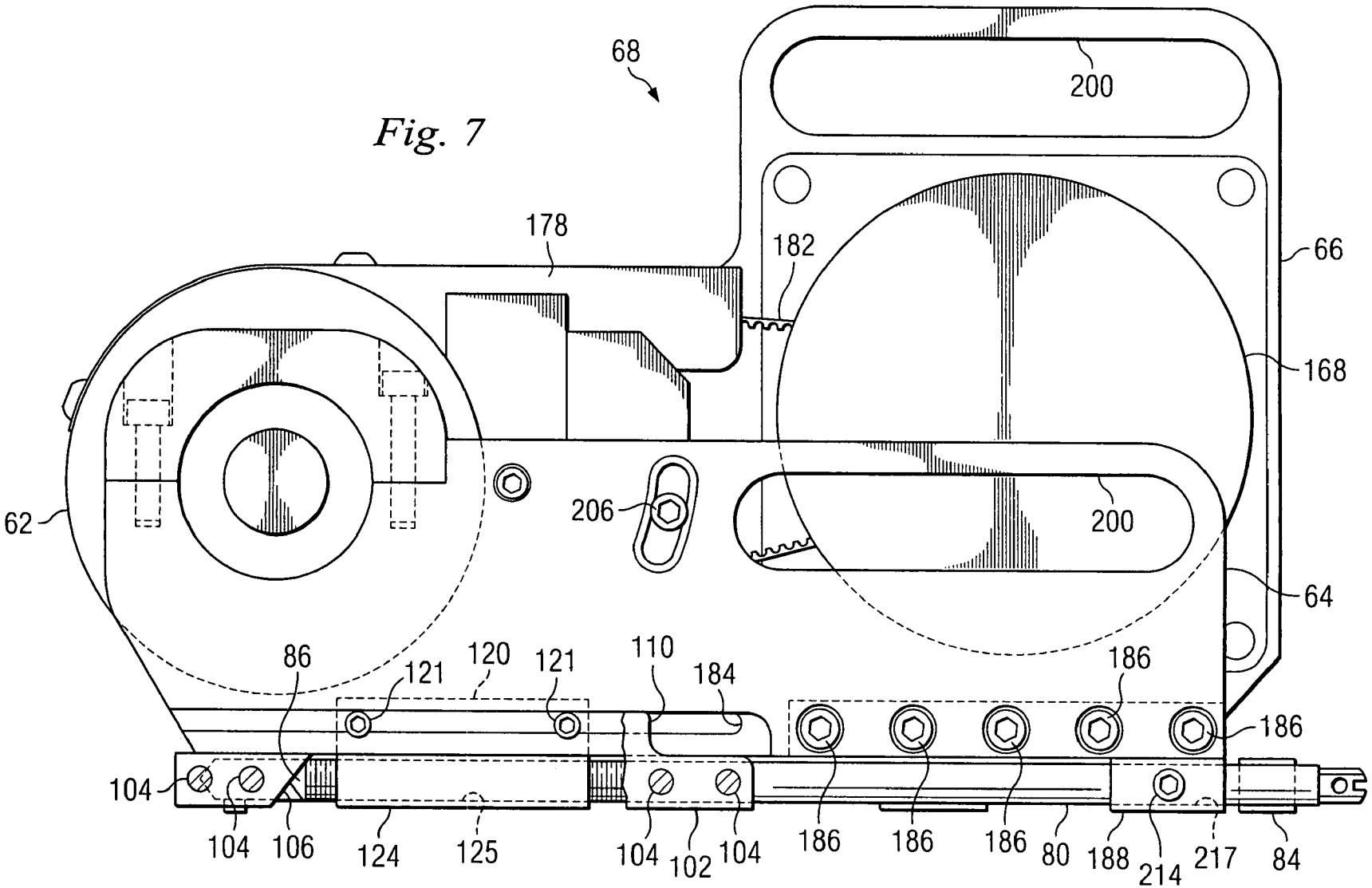
FIG. 7 is a side end view of the printer coater apparatus of the invention seen from the drive side of the press.

Referring now to FIGS. 6 and 7, a side view of printer coater apparatus 36 can be seen from the operator side and drive side respectfully. Side members 64 and 66 each comprise carrying handles 200 located on the top portion of each side member to allow for gripping and carrying printer coater 36. As seen on FIG. 7, operator side side member 66 is taller than drive side side member 64 to protect drive assembly 180, as belt guard 178 is mounted to the top of operator side member 66 to cover the moving parts. Both FIGS. 6 and 7 show printer coater 36 mounted on fixed supports 102, which are attached to the interior surfaces of the drive side and operator side of printing press frame 34 (not shown in these figures) by fixed support bolts 104. Side member slots 184, located on side frames 64 and 66, engage with the fixed support rail 110 (FIG. 9) as printer coater 36 is moved toward rotating printing surface 22 or 24.

As best seen in FIG. 7, on-stop member 80 is mounted below printer coater frame 68 in the longitudinal direction. On-stop member 80 extends through spacer block 188 and adjustment block 120, both of which are attached to printer coater frame 68. As printer coater 36 is moved toward the rotating printing surface, conical end 86 of on-stop 80 touches sloped surface 106 of fixed support member 102. This establishes the on-impression position.

As seen in FIGS. 6 and 7, the orientation angle of liquid chamber 208 with respect to the surface of anilox roller 62 can be adjusted by loosening adjustment screws 206 on the chamber and sliding the screw along slot 210 until the chamber is at the desired orientation angle. Referring to FIG. 6, the position of motor 168 is adjusted relative to frame 68 by loosening and sliding bolts 172 along motor positioning slots 170 until the motor is in the desired position. Located on the bottom of side members 64 and 66 are five equally spaced bolt holes 186 for attaching base or cross member 70 to side members 64 and 66. Drip pan 246 is mounted below anilox roller 62 to collect excess falling inking or coating material.

Anilox roller 62 is rotated synchronously with blanket cylinder 22 or plate cylinder 24 by drive assembly 180, as shown in FIG. 6. Drive assembly 180 comprises an electric motor 168, small sprocket 174, large sprocket 176 and belt 182. In operation, motor 168 and connecting shaft 169 (FIG. 5) turn the sprockets simultaneously by rotating smaller sprocket 174 which pulls belt 182 to rotate large sprocket 176. Sprocket 176 and anilox roller 62 rotate synchronously, as both pieces are connected. Belt guard 178 covers the belt and sprocket assembly to prevent injury to hands or fingers.

A sectional view of printer coater frame 68 connected to the operator side 18 of press frame 34 is shown in FIG. 9. Fixed support 102 is connected to interior surface 33 of press frame 34 by a series of bolts 104. Operator side member slot 184 slideably engages with rail 110 on fixed support 102 when inserting the printer coater in position. Spacer 90 provides adequate clearance between fixed support 102 and press frame 34 so that side support 66 does not rub against press frame interior surface 33 when sliding the printer coater into position. Different sized spacers 90 can also be used to compensate for differences between frame spacing on printing presses of the same nominal printing width that are manufactured by different companies. Alternatively, fixed support 102 can be connected directly to press frame interior surface 33 without the use of spacer 90 by varying the width of the fixed support. This facilitates the use of a universal printer coater of a given printing width on presses of different manufacture. Bolts 121 attach adjustment block 120 to side member 66. Adjustment block 120 comprises threaded on-stop opening 124 and parallel lock-on opening 122. On-stop opening 124 includes a threaded interior 125 in order to receive threaded exterior portion 82 of on-stop 80 (FIG. 11). The diameter of lock-on opening 122 is slightly larger than the diameter of lock-on 76 to allow adjustment block 120 to slide along the surface of lock-on 76 when the printer coater moves between the on and off-impression positions. Drip pan 246 is connected to block 120 to catch free falling liquid or inking substance. While FIG. 9 illustrates the connection details on operator side 18 of press 16, the same could be seen in mirror image on printing press drive side 20.

Figure 10:
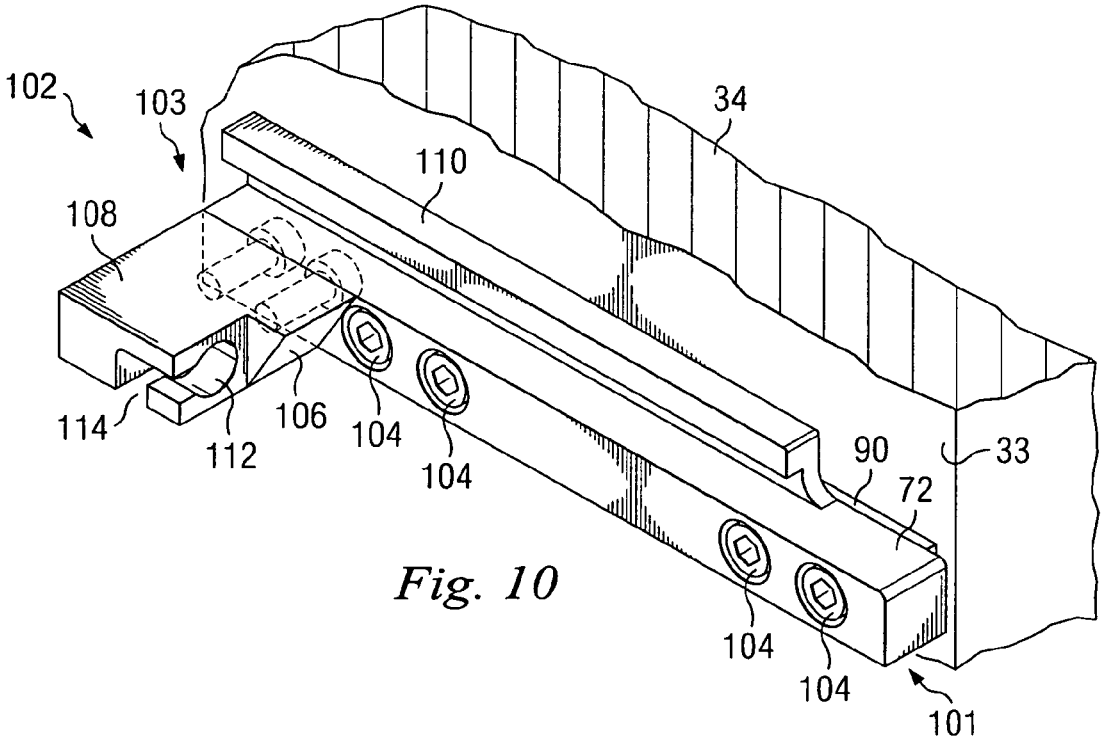
FIG. 10 shows a perspective view of one of the fixed support structures mounted on the printing press frame to support the printer coater apparatus.

FIG. 10 shows a perspective view of a right handed fixed support 102 attached to interior surface 33 of printing press frame 34. While FIG. 10 shows a right hand version for mounting on the operator side of press 16, the left hand version, for the drive side, is a mirror image of the fixed side support seen in FIG. 10. Fixed side supports 102 are mounted parallel to each other and at the same height on frame 34. Fixed supports 102 form a track on the interior surface 33 of the press frame by which printer coater 36 is supported and may slide thereon for placement in position. Fixed support 102 is attached to press frame 34 via bolts 104. A planar surface or flat 72 on first end 101 of fixed support 102 permits the operator to set printer coater side support 66 on flat 72 for alignment. While resting on flat 72, side member slot 184 (not shown herein) is aligned with rail 110 and moved forward along rail 110 to second end 103 of fixed support 102 which has a projecting portion 108 fixed thereon.

In FIG. 11 projecting portion 108 mounted on second end 103 of fixed support 102 receives the end 77 of lock-on 76 and conical end 86 of on-stop 80. Portion 108 comprises sloped surface 106, locking member chamber 112 (best seen in FIG. 10) and locking slot 114. Referring to FIGS. 10 and 11, lock-on end 77 has a pin 78 which must be aligned with slot 114 when inserting lock-on end 77 into chamber 112. When pin 78 and slot 114 are aligned, lock on end 77 can be inserted in chamber 112. Lock on grip 84 is used to rotate lock-on 76 one-quarter turn to place pin 78 in a downward and locked position, as seen in FIG. 11. While in the locked position, lock-on 76 remains stationary and cannot be moved. Lock-on 76 serves as a rail which allows printer coater 36 to slide when moving between the on and off-impression positions. In addition to functioning as a rail, lock-on 76 serves as an anchor for relative movement of the printer coater when it moves between the on and off-impression positions. As printer coater 36 is moved toward the on-impression position, conical end 86 of on-stop 80 contacts stop surface 106 to prevent any further movement in the longitudinal direction. Sloped portion 106 pushes downward on conical end 86 (FIG. 7) of on-stop 80 and thereby takes up any looseness to prevent movement which could cause vibration of the printer coater while in the on-impression position.

Referring again to FIG. 11, lock-on 76 and on-stop 80 are both located underneath cross member 70. These members are mounted parallel to each other and are oriented in the longitudinal direction. Lock-on 76 and on-stop 80 both extend through spacer block 188 and adjustment block 120. Spacer block 188 comprises two parallel openings 215 and 217 to receive lock-on 76 and on-stop 80 respectively. Opening 215 and 217 are slightly larger than the diameters of members 76 and 80 to allow the members to slide relative to block 188. Spacer block 188 is connected to cross member 70 via connecting bolts 189 and serves to maintain parallel alignment between members 76 and 80. Block 188 further comprises a set screw 214 with a nylon button 216 to control sliding movement or rotation of on-stop 80.

In FIGS. 9 and 11, adjustment block 120 and on-stop 80 are used to adjust the on-impression contact pressure between anilox roller 62 and the rotating printing surface. Threaded exterior surface portion 82 of on-stop 80 engages threaded on-stop opening 124. To adjust the contact pressure, on stop member 80 is rotated to shorten or lengthen distance "D". This allows the anilox roller position to be adjusted relative to the plate or blanket cylinder. FIG. 11 exemplifies one side of the coater apparatus 36 attached to the press frame 34; however, it should be realized the configuration occurs in mirror image on the opposite side of coater apparatus 36, not shown herein. That is, each side has a lock-on and an on-stop.

Figure 12:
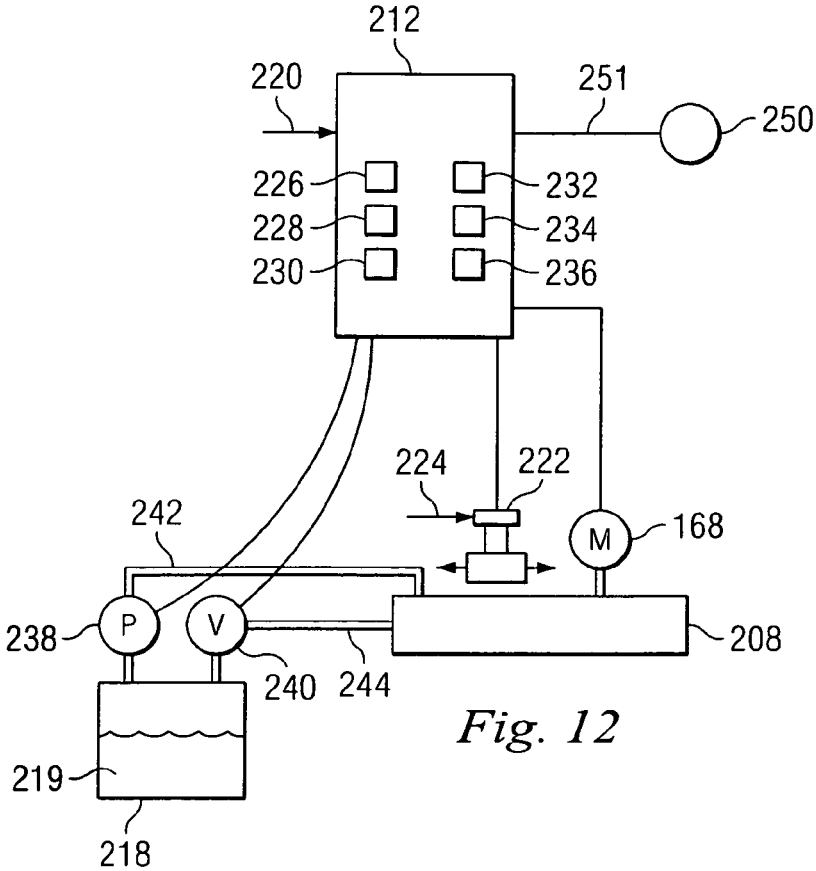
FIG. 12 is a diagram showing schematically the operation of the principal components of the printer coater controller system.

The ink or coating supply and control system is seen in FIG. 12. Control unit 212 is capable of regulating the surface speed of anilox roller 62 and the flow of inking or coating fluid into liquid chamber 208. Controller 212 comprises two inputs: a continuous power supply 220 and a voltage input 251 from tachometer 250 to regulate rotational surface speed of anilox roller 62. Controller 212 further preferably comprises a main power switch 226, a low vacuum sensor 228, a high vacuum sensor 230, a return pump controller 232, a supply pump controller 234 and an anilox controller 236 which are well known in the art.

In FIG. 12, ink or coating material 219 is pumped by pump 238 from off-press reservoir 218, through supply conduit 242 into chamber 208. The ink or coating material circulates through chamber 208 and is returned by return conduit 244 back through vacuum pump 240 to off-press source reservoir 218. The flow of ink or coating material into chamber 208 is provided in a manner as set forth in my U.S. Pat. No. 5,367,982 entitled Automatic Coating Circulation and Wash-Up System for Printing Presses, which is incorporated herein by reference. Doctor chamber 208 is preferably maintained in a vacuum condition by constantly pulling a vacuum in the manner set forth in my U.S. Pat. No. 5,207,159 entitled Coating Apparatus For Sheet-Fed Offset Rotary Printing Presses, which is incorporated herein by reference. Recirculation maintains a constant fresh supply of ink or coating material in chamber 208 at all times.

In order to rotate anilox roller 62 at or near the same surface speed as the rotating printing surface, anilox controller 236 receives the voltage signal from tachometer 250 which is mounted on the press and turns with the press. The controller 236 also receives an indication of the speed of the motor 168 and hence of the anilox roller 62. The indication may be a tachometer signal or other rotational metric. The controller interprets the input voltage and adjusts in real time the surface speed of anilox roller 62 by sending the desired output voltage to motor 168. In an embodiment, the controller 236 employs a control feedback loop, such as is well known to one skilled in the art, to drive the motor 168 to the appropriate rotational speed. The control loop may comprise a summation point which sums the indication of printer surface speed positively with a negative proportional indication of the surface speed of the anilox roller 62. The constant of proportionality in the anilox roller speed feedback path may take account of all linear offsets such as that due to different tachometer registration ranges, the gearing between the motor 168 and the anilox roller 62, and other linear offsets. The output of the summation point may drive a control component, for example a proportional integral differential (PID) controller component, that drives the input of the motor 168. In an embodiment, the output of the PID controller may be coupled to a power amplifier component which provides the output voltage to drive the motor 168. The output voltage increases or decreases the surface speed of anilox roller 62 to establish the same surface speed as the rotating printing surface. If the printer coater apparatus is to be used on a different press of the same nominal printing width, that press may also be equipped with the inexpensive tachometer 250.

Printer coater controller 212 further comprises a supply pump control 234 and a return pump control 232 to operate the system at a vacuum and to assist in circulating the inking or coating substance from reservoir 218 into chamber 208 and finally back into reservoir 218. Low vacuum and high vacuum sensors 228 and 230 continuously monitor the pressure inside chamber 208 to maintain the vacuum at all times. A pressure gauge, not shown, allows the operator to adjust the system to attain a desired vacuum pressure.

Control unit 212 may be portable so that it may be carried and placed adjacent to the printing unit where the printer coater is mounted, or it may be placed at one location with extension cables and lines for printer coater 36 running to different printing units to monitor and adjust the system if printer coater 36 is moved to different printing units. In an embodiment, a wiring harness is associated with the press 16 which provides quick connectability of the control unit 212 at any printing unit. The wiring harness provides dangling connectors at each printing unit for a control line to the inlet pump 238, a control line to the outlet pump 240, a tachometer line from the tachometer 250, and a direct current power supply line. In this embodiment, the coater 36 may be moved to any printing unit and connected with the dangling connectors located at that printing unit.

Figure 13:
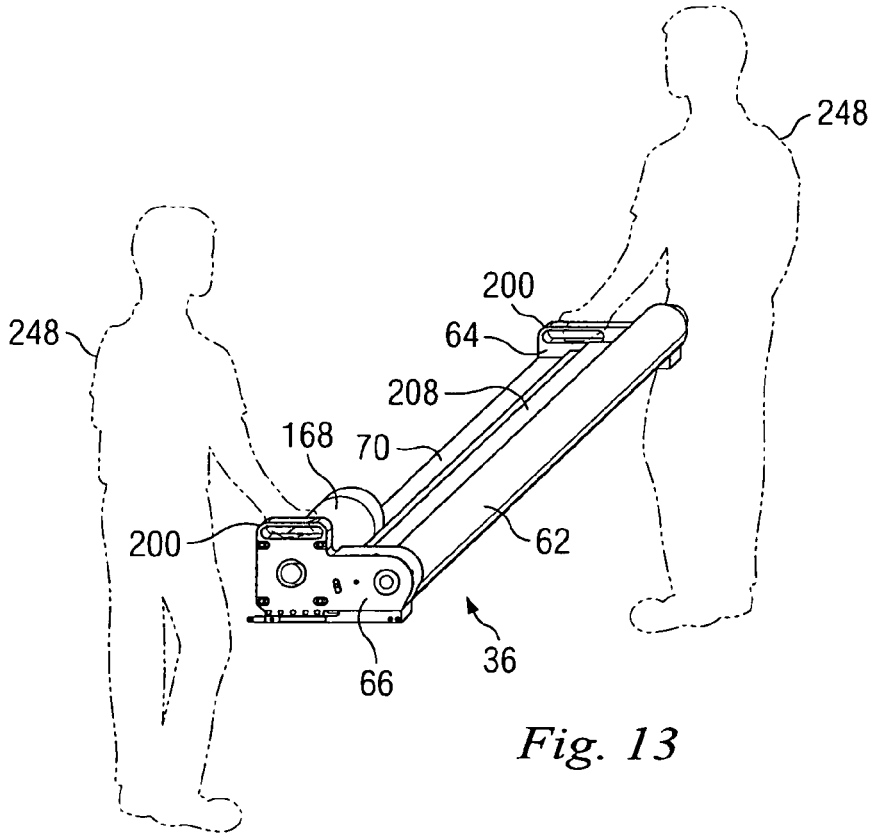
FIG. 13 shows the printer coater apparatus of the invention being carried by two press operators for installation on a printing unit.

FIG. 13 shows two humans 248 carrying printer coater apparatus 36. It is lightweight and portable so that no equipment is necessary to transport the printer coater between printing units. In order to carry and place printer coater 36 between printing units, side members 64 and 66 contain grips 200 disposed on the top portion of side members 64 and 66 to allow users to grasp and hold the unit. An exemplary compact coater printer according to the invention had an overall length of about 43 inches, an overall depth of about 12 inches and an overall height of about 7 inches. A prototype of this approximate size weighed only about 85 pounds, and it is believed improvements can be made to reduce the weight to only 75 pounds or less.

The two doctor blades 209 and the two suitable end seals are consumable items which wear out with continued use of the liquid chamber 208. When the wear on the two doctor blades 209 and/or the two end seals exceeds operational limits, excessive fluid inking or coating material may be applied to the anilox roller 62, providing undesirable printing results and/or fouling the printing press and/or the coater 36. Before beginning a printing job, operators may wish to determine whether the remaining useful life of the doctor blades 209 and/or the end seals will permit the completion of a forthcoming printing job or whether the one or more doctor blades 209 and/or end seals ought to be replaced as a preventive maintenance action before commencing the forthcoming printing job. To assist operators deciding on replacement or non-replacement of the doctor blades 208 and/or end seals, the present disclosure teaches the addition of a counter or timer to the coater 36.

Figure 14:
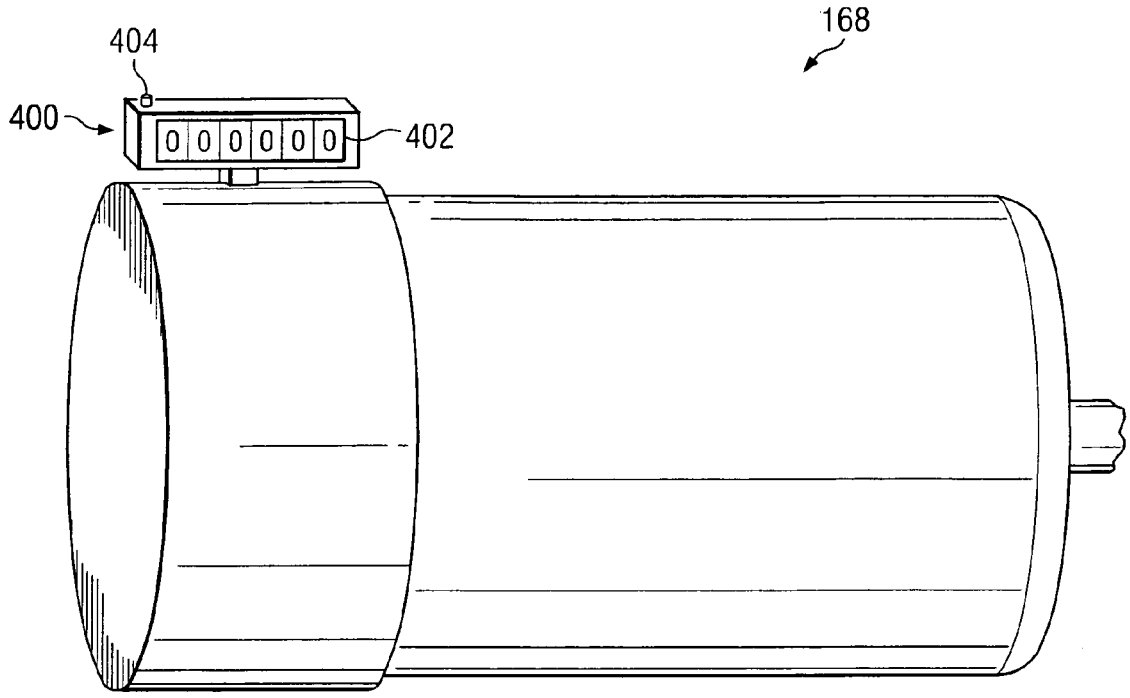
FIG. 14 shows the printer coater apparatus of the invention having a counter attached and coupled to the motor to provide an indication of life of consumable components.

Turning now to FIG. 14, a counter 400 is depicted as attached to the exterior of the motor 168. The counter 400 is coupled to the motor 168 and includes a display 402 that displays the number of revolutions or a multiple of revolutions of the motor 168. The counter 400 counts or registers as the motor 168 revolves. In an embodiment, the counter 400 is coupled to a tachometer which provides an indication of the revolution and/or the angular speed of the motor 168. The tachometer may be integrated with the motor 168. The multiple of revolutions may be hundreds, thousands, or some other multiple of revolutions of the motor 168. Because the motor 168 is coupled to the applicator roller 62, the counter 400 may display the number of revolutions or a multiple of revolutions of the applicator roller 62. The counter 400 also includes a reset button 404 that provides a means to reset the display 402 to zeros. As the motor 168 rotates, the display 402 increments accordingly. Because the applicator roller 62 is coupled to the motor 168, the display 402 provides an indication of how many times the applicator roller 62 has rotated and hence how much wear of the doctor blades 209 and end seals has occurred. An operator knowing that the doctor blades 209 have a useful life of, for example 20,000 rotations, may choose to replace the doctor blades 209 when the display 402 indicates 18,000 rotations before beginning a printing job. After replacing the doctor blades 209 the operator may activate the reset button 404 to zero the display. Because the counter 400 is coupled to the motor 168, the counter 400 increments or registers whenever the applicator roller 62 is turning, whether the printer coater 36 is on press or off press. In an embodiment, for example, the printer coater 36 may be operated and the applicator roller 62 turning and consuming lifespan of the doctor blades 209 and end seals off the press during cleaning operations.

In another embodiment, the counter 400 may decrement and may further provide a means to dial each digit of the display 402 to a desirable digit. In this embodiment, the operator may initialize the display 402 with the number of revolutions associated with the lifetime of the doctor blades 209 and/or the end seals, for example 18,000 revolutions or some multiple of 18,000 revolutions.

While the counter 400 is depicted as attached to the motor 168, one of ordinary skill in the art will readily appreciate that the counter 400 may be attached at another point on the coater 36 and an electrical cable or mechanical cable led back to the motor 168. In another embodiment, the counter 400 may be coupled to the applicator roller 62. In an embodiment, the counter 400 may be integrated into the controller 212. In the embodiment where the counter 400 is integrated into the controller 212, the counter 400 may use a tachometer signal or other angular speed metric from the motor 168 received by the controller.

In another embodiment, a timer rather than a counter 400 may be employed, either to count up time of use or to count down remaining useful lifetime of the consumable doctor blades 209 and/or end seals. Like the counter 400, the timer is coupled to the motor 168 and provides the runtime of the motor and hence the run time of the applicator roller 62 which is coupled to the motor 168. The counter 400 increments or decrements time, which may also be referred to as registering time. As above, the timer registers time whenever the motor 168 is turning, whether the printer coater 36 is on press or off press.

An advantage of the several embodiments of the counter 400 and timer is that the registration, in the form of the display 402, of consumed or remaining lifetime of the consumables is physically linked to the coater 36. If a coater 36 is used in a printing shop with several separate printing presses 16, the coater 36 may be relocated to different printing presses 16 and the registration of consumed or remaining lifetime of the consumables remains linked to the coater 36. If the counter 400 or timer were instead coupled to the printing press 16, the direct linkage to the coater 36 may not be observed when the coater 36 is moved from a first printing press 16 to a second printing press 16.

Figures 15A, 15B:
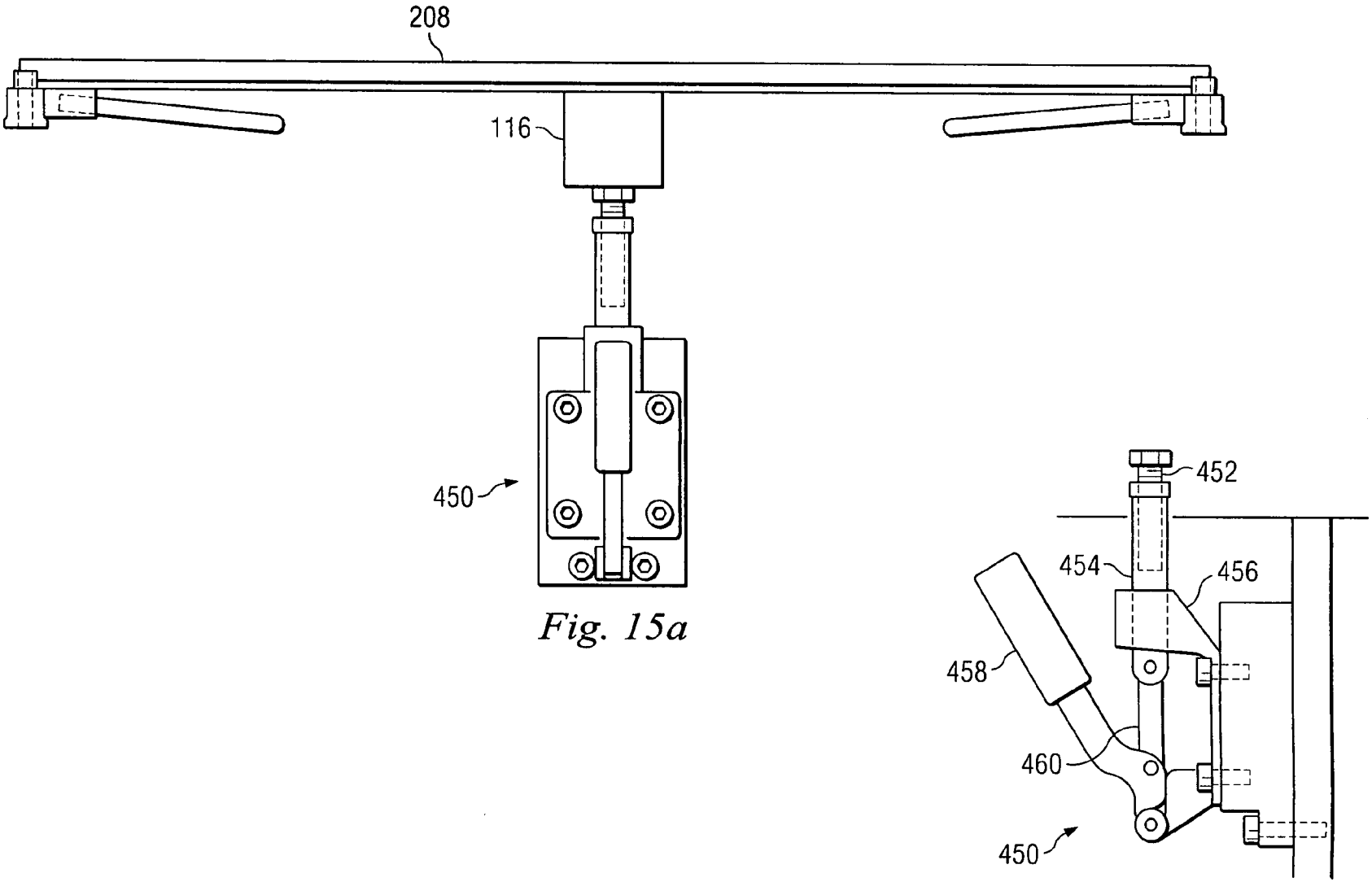
FIG. 15*a* shows a top view of the printer coater apparatus with an adjustable tensioner disposed to tension the liquid chamber against the applicator roll.
FIG. 15*b* shows a side view of the adjustable tensioner.

Tuning now to FIG. 15*a*, a top view of the liquid chamber 208 and an adjustable tensioner 450 is shown. The adjustable tensioner 450 is configured to apply an adjustable pressure to the back of the liquid chamber 208.

Turning now to FIG. 15*b*, a side view of the adjustable tensioner 450 is shown. As shown, the adjustable tensioner 450 is adjusted by turning a threaded bolt 452 in a threaded sleeve 454. The threaded sleeve 454 is slidably retained within fixture 456 which is bolted to the cross member 70. A lever 458 is linked to the threaded sleeve 454 by link 460. Operating the lever 458 locks the adjustable tensioner 450, the threaded bolt 452 pressing up against the back of the liquid chamber 208. In another embodiment, the fixture 456 may have a threaded hole through which a threaded bolt extends out to the back of the liquid chamber 208 and the opposite end of the threaded bolt extends through the other end of the threaded hole in the fixture 456 and then makes a right angle to provide a lever for hand turning to adjust pressure. Other pressure adjustment mechanisms will readily present themselves to one of ordinary skill in the art, all of which are contemplated by the present disclosure. The doctor blades 209 and the end seals effectively behave like springs, bending and deforming as more pressure is applied to the back of the liquid chamber 208 by the adjustable tensioner 450 or other adjustable attachment hardware at the drive end and the operator end of the liquid chamber. The adjustable tensioner 450 is depicted as located to apply adjustable pressure substantially in the middle of the liquid chamber 208, directly upon the fluid entry port 116, but in other embodiments the adjustable tensioner 450 may be located at other positions so as to apply adjustable pressure between the ends of the liquid chamber 208. Additionally, more than one adjustable tensioner 450 may be employed to apply adjustable pressure between the ends of the liquid chamber 208.

It has been observed that a liquid chamber 208 tensioned against the applicator roller 62 using only adjustable attachment hardware at the drive end and the operator end of the liquid chamber 208 deforms away from the applicator roller 62 in the middle portion of the liquid chamber 208 due to the spring tension inherent in the doctor blades 209. This deformation is undesirable, as it leads to applying greater tension using the adjustable attachment hardware at the drive end and the operator end of the liquid chamber 208, and this greater tension may diminish the life expectancy of the consumables including the doctor blades 209 and the end seals due to excessive wear at the ends and/or uneven wear across the length of the doctor blades 209. This observation was made indirectly during the course of monitoring the difference between inlet and outlet pressure to the liquid chamber 208 and attempting to adjust tension of the liquid chamber 208 against the applicator roller 62 in order to achieve desirable inlet to outlet pressure differential. The adjusting operator happened to press on the back of the liquid chamber 208 substantially in the middle and observed an improvement of inlet to outlet pressure differential. Further reflection on this experience lead to the conclusion, previously not understood or anticipated, that the seemingly rigid liquid chamber 208 was deforming slightly along its length and that this deformation required excessive end tension against the applicator roller 62 to achieve acceptable tension in the middle of the liquid chamber 208 against the applicator roller 62. It was found, during this experiment, that the quick release handles 88 at the two ends of the liquid chamber 208 could be released and applying pressure onto the back of the liquid chamber 208 was sufficient to maintain the desirable inlet to outlet pressure differential. The fluid entry port 116 may provide structural stiffness to the center of the liquid chamber 208, and this structural stiffness may enhance the beneficial effect of applying pressure to the middle of the liquid chamber 208 via the fluid entry port 116. There may be a synergistic cooperation between applying pressure in the middle of the liquid chamber 208 and using the structural stiffness of the fluid entry port 116 to apply this pressure to the middle of the liquid chamber 208. In an embodiment, it is desirable to exert pressure on the middle of the liquid chamber 208 as well as on the ends of the liquid chamber 208 via the clamping action of the quick release handles 88.

In an embodiment, a teflon lining or coating is applied to the interior metal faces of the liquid chamber 208 and/or to the drip pan 246. This teflon lining or coating eases the task of cleanup of the coater 36 after a printing run.

The coater 36 is transportable by two operators. In some printing enterprises, however, it is desirable for a single operator to install and remove the coater 36 unassisted by additional personnel. Accordingly, a system to promote installation and removal of the coater 36 by a single unassisted operator is disclosed.

Figure 16:
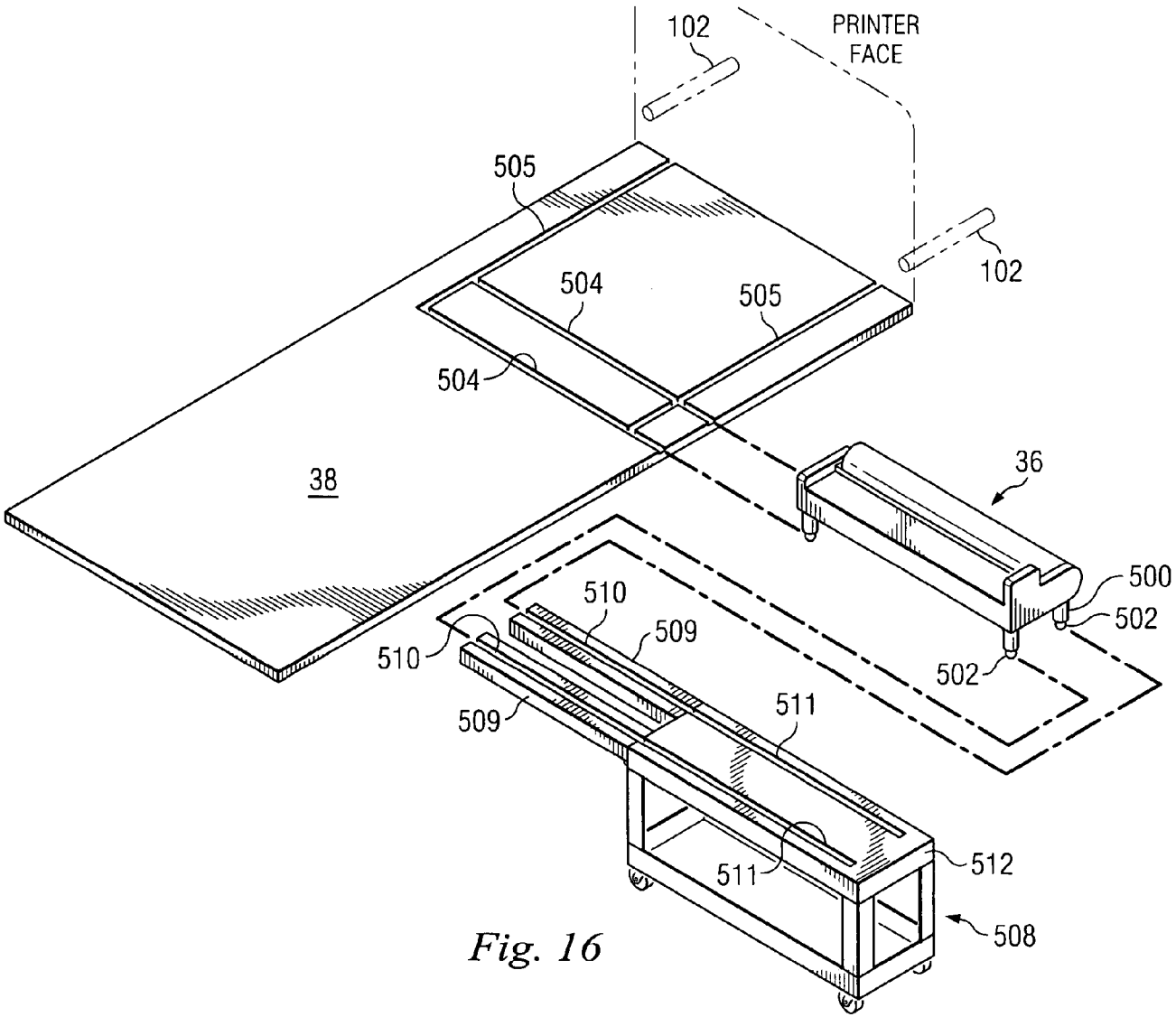
FIG. 16 illustrates an embodiment of a system for permitting a single unassisted operator to install and remove the printer coater apparatus to and from the printer press.

Turning now to FIG. 16, a system for aiding unassisted installation and removal of the coater 36 by a single unassisted operator is depicted. Four feet 500 are attached to the underside of the coater 36 having rollers 502. The rollers 502 promote easy planar motion of the coater 36 in any direction. The catwalk 38 is shown attached to the face of the printer press 16. The catwalk 38 is substantially flat and horizontal and is shown to have two parallel grooves 504 substantially parallel to the face of the printer press 16 and two perpendicular grooves 505 substantially perpendicular to the face of the printer press 16. The grooves are disposed to engage the rollers 502 and to guide moving the coater 36 onto the catwalk 38 and up to the face of the printer press 16 to mount onto fixed supports 102. The catwalk 38 and the fixed supports 102 are vertically aligned so that the coater 36, supported by the feet 500 and rollers 502 on the two perpendicular grooves 505, readily slides into place on the fixed supports 102. In an embodiment, either fewer grooves or no grooves may be formed in the catwalk 38. With no grooves formed in the catwalk 38, the operator is called upon to provide manually the guiding action otherwise provided by the grooves 504 and 505.

A movable cart 508 has two bridge members 509 having at least a first groove 510 that aligns with one of or both of the two parallel grooves 504. The movable cart 508 has at least one groove 511 in its top 512 that aligns with the groove 510 in the two bridge members 509. The two bridge members 509 are hinged to the movable cart 508. The coater 36 may be placed on top of the movable cart 508, the rollers 502 placed in the groove 511 in the top 512. The movable cart 508 may be brought to the printer press 16 and the two bridge members 509 raised on their hinges and locked into place, the groove 510 in the two bridge members 509 aligned with the two parallel grooves 504 of the catwalk 38. The coater 36 may be easily rolled from the movable cart 508 onto the two bridge members 509, from the two bridge members 509 onto the catwalk 38, and then using grooves 505 rolled up to the face of the printer press 16 and mounted onto the fixed supports 102 by a single unassisted operator. In the preferred embodiment only a single groove 509 is present on the two bridge members 509 and only a single groove 511 is present in the top 512 of the movable cart 508.

While in the present embodiment the coater 36 has four feet 500 and four rollers 502, in other embodiments other configurations may be employed. For example, a single foot 500 and a single roller 502 may be provided to provide for rolling onto and off of the catwalk 38 and several resting feet may be provided merely to hold the coater 36 in repose. Alternately, no resting feet may be provided and the coater 36 may be permitted to lean over on the movable cart 508 when in repose. Because the catwalk 38 may have different heights at different positions of the printer press 16, in an embodiment, the movable cart 508 may have a height adjustment mechanism to accommodate different heights of the catwalk 38. In another embodiment, the two bridge members 509 may not lock into a horizontal position, but may overlap and/or latch onto the catwalk 38 at a variable angle determined by the relative heights of the movable cart 508 and of the catwalk 38. In an embodiment, the feet 500 may also be adjustable in height.

Figure 17:
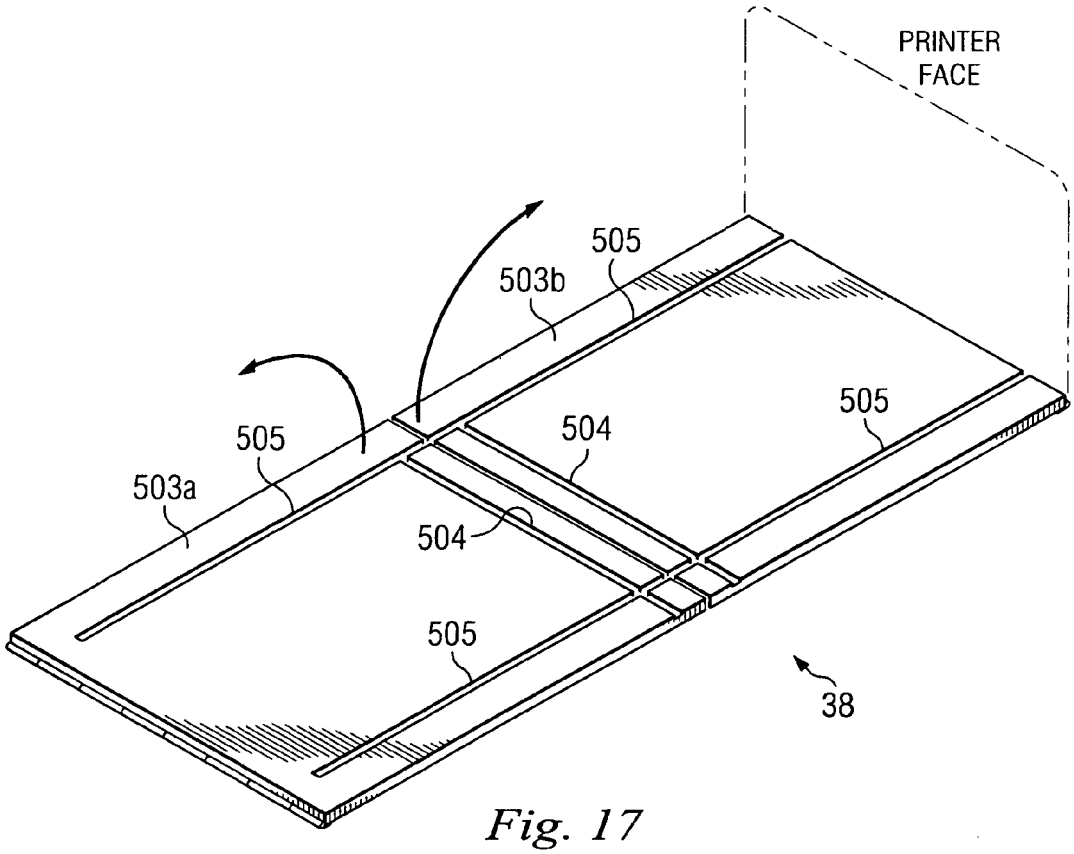
FIG. 17 illustrates a sectioned and hinged platform of the system for permitting a single unassisted operator to install and remove the printer coater apparatus.

Turning now to FIG. 17, the catwalk 38 is shown comprising a first hinged portion 503*a* and a second hinged portion 503*b*. In operation substrate portions may fall out of the printer press 16, under the catwalk 38, and need to be recovered before proceeding. Recovery may more convenient if the catwalk 38 is lifted to gain access to the substrate portion. Equipment located under the catwalk 38 may break and require repair or may need periodic adjustment. Access to equipment located under the catwalk 38 may be improved by lifting the catwalk 38. If the catwalk 38 were continuous, lifting the catwalk 38 might first require removal of the coater 36 from the fixed supports 102 and onto the movable cart. A sectioned catwalk 38 advantageously permits the removal of substrate portions without removing the coater 36 to the movable cart. In one circumstance it may only be necessary to lift the first hinged portion 503*a* to gain access to and remove the substrate portion. In another circumstance it may be necessary to roll the coater 36 onto the first hinged portion 503*a* before lifting the second hinged portion 503*b* to remove the substrate portion. In an embodiment, the first hinged portion 503*a* itself is segmented and hinged, permitting folding the first hinged portion 503*a* back on itself. In another embodiment, the catwalk 38 is segmented into portions and are lifted off of the printer press 16 to gain access to substrate portions. The perpendicular grooves 505 are preferably extended back onto the first hinged portion 503*a* to allow the coater 36 to be rolled back onto the first hinged portion 503*a* of the catwalk 38 when lifting the second hinged portion 503*b*. Different configurations of catwalks 38 and different partitionings of the catwalk 38 into folding sections may be needed to accommodate the particular shapes and dimensions of the presses 16 of different manufacturers. These and other sectioned and hinged configurations of the catwalk 38 are all contemplated by the present disclosure.

Although the invention has been described with particular reference to presently preferred embodiments thereof, it will be appreciated that various modifications, alterations, variations, etc., may be made without departing from the spirit and scope of the invention as defined in the claims. Also, techniques, systems, subsystems and methods described and illustrated in the various embodiments as discrete or separate may be combined or integrated with other systems, modules, techniques, or methods without departing from the scope of the present disclosure. Other items shown as directly coupled or communicating with each other may be coupled through some interface or device, such that the items may no longer be considered directly coupled to each but may still be indirectly coupled and in communication with one another. Other examples of changes, substitutions, and alterations are ascertainable by one skilled in the art and could be made without departing from the spirit and scope disclosed herein.

What is claimed is:

1. A system for installing a portable printer coater in, and removing a portable printer coater from, a printing unit, comprising:

one or more rollers coupled to a portable printer coater, the rollers operable to bear at least a portion of the weight of the portable printer coater;

a two part catwalk operable to support the rollers and position the portable printer coater for engagement with the printing unit, at least partially movable while the portable printer coater remains installed in a printing unit; and a movable cart operable to bear the weight of the portable printer coater during transport to and from the printing unit;

wherein the movable cart is supported on wheels, has two substantially parallel rails attached to a top of the movable cart, at least one of the rails having a groove operable to receive a roller;

wherein the movable cart further includes two hinged extension rails coupled to extend the two substantially parallel rails attached to the top of the movable cart.

2. The system of claim 1, wherein the two part catwalk is at least partially removable while the portable printer coater remains installed in a printing unit.

3. The system of claim 1, wherein the two pad catwalk has at least one groove operable to receive a roller and wherein the groove is operable to guide the positioning of the portable printer coater for installing into and removing from the printing unit.

4. The system of claim 1, wherein the portable printer coater has four rollers, the two part catwalk has two grooves substantially parallel and two grooves substantially perpendicular to the long axis of the portable printer coater when installed into the printing unit, the four rollers align with the two substantially parallel grooves to move the portable printer coater parallel to the printing unit, and the four rollers align with the two substantially perpendicular grooves to move the portable printer coater perpendicular to the printing unit.

5. The system of claim 1, wherein at least one extension rail comprises a groove adapted to receive and guide a roller.

6. The system of claim 1, wherein the extension rails have a length selected to extend from the cart to the catwalk.

7. The system of claim 1, further comprising temporary attachment means for coupling the extension rails to the catwalk.

8. The system of claim 1, further including at least one resting foot.

9. A system for installing a portable printer coater in, and removing a portable printer coater from, a printing unit, comprising:

one or more rollers coupled to a portable printer coater, the rollers operable to bear at least a portion of the weight of the portable printer coater; and a two part catwalk operable to support the rollers and position the portable printer coater for engagement with the printing unit, at least partially movable while the portable printer coater remains installed in a printing unit;

wherein one part of the catwalk is comprised of two segments hinged together and operable to fold onto each other.

10. The system of claim 9, wherein the two part catwalk is at least partially removable while the portable printer coater remains installed in a printing unit.

11. The system of claim 9, wherein the two part catwalk has at least one groove operable to receive a roller and wherein the groove is operable to guide the positioning of the portable printer coater for installing into and removing from the printing unit.

12. The system of claim 9, wherein the portable printer coater has four rollers, the two part catwalk has two grooves substantially parallel and two grooves substantially perpendicular to the long axis of the portable printer coater when installed into the printing unit, the four rollers align with the two substantially parallel grooves to move the portable printer coater parallel to the printing unit, and the four rollers align with the two substantially perpendicular grooves to move the portable printer coater perpendicular to the printing unit.

* * * * *

UNITED STATES PATENT AND TRADEMARK OFFICE

CERTIFICATE OF CORRECTION

PATENT NO. : 7,273,007 B2
APPLICATION NO. : 10/962021
DATED : September 25, 2007
INVENTOR(S) : DeMoore et al.

It is certified that error appears in the above-identified patent and that said Letters Patent is hereby corrected as shown below:

Col. 16, Line 22, replace "pad" with -- part--

Signed and Sealed this

Eighteenth Day of December, 2007

JON W. DUDAS
*Director of the United States Patent and Trademark Office*